United States Patent [19]

Hellsten et al.

[11] 4,384,965

[45] May 24, 1983

[54] METHOD FOR THE MECHANICAL WORKING OF METALS AND LUBRICANT CONCENTRATE

[75] Inventors: Karl M. E. Hellsten, UMl/O/ dsmal; Birgit T. G. Karlsson, Stenungsund, both of Sweden

[73] Assignee: Berol Kemi AB, Stenungsund, Sweden

[21] Appl. No.: 231,815

[22] Filed: Feb. 5, 1981

[30] Foreign Application Priority Data

Feb. 11, 1980 [SE] Sweden ..... 8001059

[51] Int. Cl.[3] ..... C10M 1/06; C10M 1/46

[52] U.S. Cl. ..... 252/32.5; 252/49.3; 252/49.5

[58] Field of Search ..... 252/32.5, 49.3, 49.5

[56] References Cited

U.S. PATENT DOCUMENTS

| | | | |
|---|---|---|---|
| 3,558,489 | 1/1971 | Matson | 252/49.5 X |
| 3,718,588 | 2/1973 | Bellos et al. | 252/49.5 X |
| 3,788,988 | 1/1974 | Dubourg | 252/49.5 X |
| 3,860,521 | 1/1975 | Aepli et al. | 252/49.5 X |
| 3,933,658 | 1/1976 | Beiswanger et al. | 252/49.5 X |
| 3,945,930 | 3/1976 | Sugiyama et al. | 252/49.5 X |
| 4,138,346 | 2/1979 | Nassry et al. | 252/49.5 X |
| 4,151,099 | 9/1979 | Nassry et al. | 252/49.5 X |
| 4,160,370 | 7/1979 | Hacias | 252/49.5 X |
| 4,261,842 | 4/1981 | Busch et al. | 252/49.5 |

*Primary Examiner*—Thomas A. Waltz

[57] ABSTRACT

During mechanical working, an aqueous lubricant composition is used as a lubricating and cooling agent, which contains an ether phosphate as a lubricating agent. A concentrate suitable for use as a lubricant after dilution with water is also described.

10 Claims, No Drawings

METHOD FOR THE MECHANICAL WORKING OF METALS AND LUBRICANT CONCENTRATE

The present invention relates to a method for the mechanical working of metals and concentrates suitable, after dilution with water, for use as a lubricant in mechanical metal working.

The mechanical working of metals, for example forming, cutting and grinding, generally generates so much heat that both the life of the working tool and the speed of working is limited considerably. An attempt to reduce the amount of heat developed has therefore been made by lubrication and cooling. For this purpose, aqueous lubricant systems have long been used, which contain anionic surface active agents as a lubricating component. The anionic surface active compounds which have used have generally been soaps, often in combination with other anionic surface active compounds. Through the U.S. Pat. No. 3,372,117 it is known to combine a surface active compound consisting of a mixture of a soap and an alkyl ether phosphate with inter alia a polyethylene oxide adduct. This lubricant has proved valuable for lubricating chemically coated metal surfaces before deformation, since the lubricant only attacks chemical coatings, such as phosphate, oxide, sulphide and oxalate coatings to a small extent, on the metal surface.

It has now surprisingly been found that during the working of metals the life of the working tool can be prolonged and/or the working speed can be increased considerably by carrying out the working process in the presence of a specific lubricant. When applying the invention it has been found possible in many cases to prolong the life of the working tool by over 10 times in comparison with when conventional aqueous lubricants are used. In addition, the lubricant composition according to the invention provides a very satisfactory temporary protection against corrosion. The aqueous lubricant composition according to the invention has a pH value of 7.5–10.5 and contains a specific anionic surface active compound as a lubricating agent. The anionic surface active compound consists of an ether phosphate with the general formula

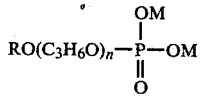

I in which R is a hydrocarbon group with 6–24, preferably 12–22 carbon atoms, n is 1–4 and M is hydrogen or a monovalent cation.

The amount of ether phosphate is 0.5–20 grams per 1000 grams of lubricant composition. Apart from the ether phosphate, one or more additional surface active compounds may also be included in the lubricant composition, preferably in the form of a nonionic surface active and/or anionic surface active compounds but cationic surface active compounds may also be considered. The amount of these surface active agents is generally within the range of 0.5–30 grams per 1000 grams of the lubricant composition. It also lies within the scope of the invention to add a non-surface active polymer compound of the polyalkyleneglycol type, suitably in an amount of up to 20 parts by weight, preferably in the range of 0.5–15 parts by weight, per 1000 parts by weight of lubricant composition and, if so desired, conventional solubility-imparting hydroxyl compounds. PH-regulating agents, anti-corrosion agents and biocides can also be added when necessary.

Within the scope of the invention, a lubricant concentrate can easily be produced which meets the following requirements.

1. A clear liquid between +5° C. and +30° C.
2. Is reformed spontaneously on thawing
3. Low odour level
4. Low foaming
5. Easily soluble in water—does not form a gel
6. Useful solutions within the concentration range of 0.5–20 percent by weight are prepared by dilution with water.

The properties in the requirements are of importance in order to obtain a lubricant composition which is handy and which does not require any special arrangement for its use.

Preferred ether phosphates according to the invention are those in which R in the above formula designates an alkyl group with 12–22, most preferably 16–18 carbon atoms and n is a number from 1–2. Specific examples of ether phosphates are mono-n-hexadecyltri (oxypropylene)phosphoric acid, mono-n-heptadecyldi(oxypropylene) phosphoric acid, mono-n-octadecyldi(oxypropylene) phosphoric acid, mono-n-hexadecyloxypropylene phosphoric acid, mono-n-heptadecyloxypropylene phosphoric acid and mono-n-octadecyloxypropylene phosphoric acid as well as sodium and potassium salts thereof.

The nonionic surface active compound according to the invention can consist of all known types with a satisfactory wetting capacity. Primary attention should be given to alkylene oxide adducts of monoalkyl phenols, dialkyl phenols, fatty alcohols, secondary alcohols, fatty acids, fatty acid amides and alkyl mercaptans, as well as alkyl sulphides, alkylsulphoxides and alkyl sulphones containing hydroxyl, in which compounds the total number of carbon atoms in the hydrophobic parts amounts to 8–22 carbon atoms, and the polyalkyleneglyvol chain comprises 2–40 alkyleneglycol groups. Particularly preferred are the nonionic compounds which are included in the general formula $$RO(C_2H_4O)_{p1}(C_nH_{2n}O)_{p2}H \qquad \text{II}$$

in which R is an aliphatic of aliphatic substituted group with 8–22, preferably 8–14 carbon atoms or a mono- or dialkylphenyl group with a total of 4–24, preferably 8–18 carbon atoms in the alkyl groups, n is a number 3 or 4, $p_1$ is a number 2–40, preferably 3–12, when R is an aliphatic or aliphatic substituted group, and 2–18 when R is a mono- or dialkylphenyl group and $p_2$ is a number 0–5, preferably 0–3. Specific examples of suitable nonionic surface active compounds which are covered by this formula are ethylene oxide adducts with decylalcohol, lauryl alcohol, myristyl alcohol, cetyl alcohol, stearyl alcohol, eicosyl alcohol, cleyl alcohol, ethylcyclohexanol, hexylcyclohexanol, decylcyclohexanol, octyl phenol, nonyl phenol, dodecyl phenol, hexadecyl phenol, dibutyl phenol dioctyl phenol and dinonyl phenol.

Other suitable nonionic surface active compounds are alkylene oxide adducts of naturally or synthetically derived carboxylic acids and alkylmercaptans. These compounds can be illustrated by the general formula $$RA(C_2H_4O)_{p1}(C_nH_{2n}O)_{p2}H \qquad \text{III}$$

in which R and n, $p_1$ and $p_2$ have the meaning given under formula II while A signifies sulphur or the group

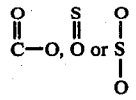

Suitable nonionic active compounds are also alkylamidoalkylene oxide adducts, preferably with the general formula

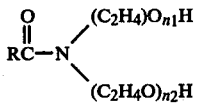

IV in which R has the meaning given under formula II and $n_1$ and $n_2$ are a number from 2–40.

A further group of nonionic surface active compounds which can be used in this connection are the so-called block polymers. These are built up of blocks consisting of addition polymers of ethylene oxide, propylene oxide and possibly butylene oxide. The molecular weight of the propylene oxide or butylene oxide part or parts should be within the range 1000–4000 while the polyethylene oxide part or parts have a molecular weight of about 500–2000.

If so desired, the nonionic surface active compounds may be wholly or partially replaced by anionic surface active compounds, such as alkylarylsulphonates, fatty acid soaps, alkyl sulphates and alkyl phosphates. Of the anionic surface active compounds the alkyl phosphates having the general formula

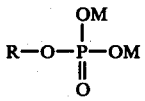

V in which R and M have the meaning given under formula I are preferred as they in combination with the ether phosphate improve the lubricating properties. Cationic surface active compounds may also be considered and of these those which have quaternary nitrogen atoms are preferred. The cationic surface active compounds also have the advantage of having certain bactericidal properties.

Non-surface active polymer compounds of the polyalkylene glycol type which are suitable for inclusion in the present invention can be summarized by the following general formula $$R_1[O(A)_xG]_n \qquad \text{VI}$$

in which $R_1$ designates a hydrocarbon residue of a hydroxyl-substituted hydrocarbon residue, the hydrocarbon residue containing 1–6 carbon atoms, G signifies hydrogen or a hydrocarbon residue or an acyl group with 1–22 carbon atoms, A designates an oxyalkylene group derived from an alkylene oxide with 2–4 carbon atoms, x designates a number from 4–200 and n is a number from 1–6. Usually compounds are preferred in which at least 50% of the oxyalkylene groups are derived from propyleneoxide. Polyalkyleneglycol compounds according to the invention can be produced by cenverting acyclic or isocyclic, mono- or polyfunctional hydroxyl compounds containing 1–6 carbon atoms with alkylene oxide with 2–4 carbon atoms or mixtures thereof. If it is found suitable the hydroxyl groups obtained after the alkylene oxide addition can be etherified or esterified with a suitable compound. Examples of suitable monofunctional hydroxyl compounds are methanol, ethanol, propanol, butanol, hexanol and cyclohexanol. Examples of polyfunctional hydroxyl compounds are glycerol, trimethylolpropane, butylene glycol, butane triol, hexane triol and pentaerytritol. A suitable class of alkylene oxide compounds are those which are illustrated by the general formula $$R_1(A)_xOH \qquad \text{VII}$$

in which $R_1$, A and x have the meanings given under formula VI.

Preferred compounds according to the invention are those which are covered by the general formula $$H(A)_xOH \qquad \text{VIII}$$

in which x and A have the meanings given under formula VI. An example of a compound which is covered by this formula is polypropylene glycol.

In order to increase the stability of the lubricant composition, it is possible, if desired, to add a solubility improving agent containing hydroxyl. Examples of such compounds are monoethylethylene glycol, propylene glycol, butyldiethylene glycol and ethylene glycol.

When preparing the lubricant composition according to the invention it is best to prepare a concentrate first. The preparation of the concentrate takes place in such a manner that the various components are added to suitable amount of water. It is advisable first to prepare an aqueous solution of ether phosphate according to the present invention and the surface active agents, after which the polymer compounds and solvent improving additives are usually introduced with lighter agitation. The amount of water in relation to the other components may appropriately be selected in such a manner that a water content of about 10–70 percent by weight of the weight of the concentrate is obtained. Typical concentrate formulations are the following.

| | |
|---|---|
| Ether phosphate | 2–50 preferably 5–30 percent by weight |
| Nonionic surface active compound | 2–60 preferably 5–35 percent by weight |
| Anionic surface active compound, for example alkyl phosphate | 0–30 preferably 2–15 percent by weight |
| Cationic surface active compound | 0–30 preferably 0–5 percent by weight |
| Polymer alkylene oxide adduct | 0–40 preferably 10–30 percent by weight |
| Solubility agent | 0–40 preferably 10–30 percent by weight |
| Biocide | 0–5 preferably 0.5–3 percent by weight |
| Water | 10–70 preferably 20–50 percent by weight |

Before use, the concentrate is diluted with water so that the solution used has a water content of 99.5–80 percent by weight.

The invention is further illustrated by the following examples.

EXAMPLE 1

The lubricant concentrates A–E containing the following components were produced.

| Component, percentage by weight | A | B | C | D | E |
|---|---|---|---|---|---|
| $C_{16-18}$—alkyl-O—$(PO)_{1.6}$—PO(OK)(OK) | 8.3 | 8.3 | 2.8 | 13.3 | — |
| $C_{14-16}$—alkyl-O—$(EO)_{2.0}$—P(=O)(OK)(OK) | — | — | — | — | 8.3 |
| Decyl phosphate | — | 8.3 | 2.8 | 13.3 | — |
| Polypropylene glycol molecular weight 1200 | 15 | — | 26 | 5 | — |
| Polyethylene glycol molecular weight 1000 | — | 15 | — | — | 15 |
| $C_9H_{17}$—C$_6$H$_4$—O—$(EO)_4$—H | — | — | 20 | 20 | — |
| $C_9H_{17}$—C$_6$H$_4$—O—$(EO)_{10}$—H | — | 1.5 | 1.5 | 1.5 | — |
| Quaternary ammonium compound | — | 1.5 | 1.5 | 1.5 | — |
| Propylene glycol | — | 15 | 15 | 15 | — |
| Water | up to 100% | | | | |

EO = oxyethylene
PO = oxypropylene

The concentrate E is not covered by the invention but is included in the experiment for comparison. The concentrates A–E were then diluted with 20 parts of water, suitable solutions for use being obtained with a pH value of about 8.9.

The lubricant compositions obtained were then tested in a twist-drill test with a view to the life of the drill expressed as the number of holes which could be drilled before the drill was worn out. For the drill test, a high-speed steel drill of the material SIS 2724 with a diameter of 6 mm was used. The material of the workpiece was SIS 2541-03. The cutting speed was 20 m/min and 25 m/min while the feed went up to 0.17 mm/revolution. The depth of the hole drilled was 24 mm. The following result was obtained.

| Composition | Number of holes: Cutting speed 25 m/min | Number of holes: Cutting speed 20 m/min |
|---|---|---|
| A | 46 | 160 |
| B | 68 | 200 |
| C | 135 | 200 |
| D | 170 | 200 |
| E | 30 | 105 |

The results show that all the lubricant compositions according to the invention are substantially superior to the comparison composition E. The compositions C and D display particularly advantageous properties.

EXAMPLE 2

A ring compression test was carried out at 25° C. using a lubricant composition based on concentrate B in Example 1 diluted with 95 parts water per 5 parts concentrate. The coefficient of friction was determined in accordance with Burgdorfs method at a thickness reduction of 30% to 0,11. The corresponding value without any lubricant was 0,32.

We claim:

1. A method for the mechanical working of metals, which comprises carrying out the mechanical working in the presence of an aqueous lubricant composition comprising an ether phosphate with the general formula

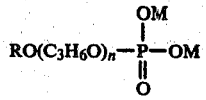

in which R is a hydrocarbon group having from six to twenty-four carbon atoms, n is 1 to 4 and M is hydrogen or a monovalent cation, in an amount within the range from 0.5 to 20 parts by weight per thousand parts of composition and which has a pH value within the range from 7.5 to 10.5.

2. Method according to claim 1, in which R is an alkyl group having from 15 to 20 carbon atoms and n is a number from 1 to 2.

3. Method according to claim 1, in which the lubricant composition further contains one or more surface active compounds in an amount within the range from 0.5 to 30 parts by weight per thousand parts of composition.

4. Method according to claim 3, in which the surface active compound is a nonionic compound with the general formula $$RO(C_2H_4O)_{p1}(C_nH_{2n}O)_{p2}H$$

in which R is selected from the group consisting of aliphatic and cycloaliphatic groups having from 8 to 22 carbon atoms and mono- and dialkylphenyl groups having from 4 to 24 carbon atoms in the alkyl groups; n is 3 or 4, $p_1$ is a number from 2 to 40 when R is an aliphatic or cycloaliphatic group, and from 2 to 18 when R is a mono- or dialkylphenyl group; and $p_2$ is a number from 0 to 5.

5. Method according to claim 3, in which the surface active compound is selected from the group consisting of anionic and cationic surface active compounds.

6. Method according to claim 5, in which the anionic surface active compound is an alkylphosphate having the general formula

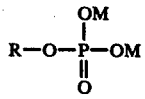

in which R is a hydrocarbon group having from six to twenty-four carbon atoms, and M is hydrogen or a monovalent cation, in an amount within the range from 0.5 to 20 parts by weight per thousand parts of composition and which has a pH value within the range from 7.5 to 10.5.

7. Method according to claim 1 in which the lubricant composition further contains a non-surface active polyalkylene glycol in an amount within the range from 0 to 20 parts by weight per thousand parts of composition.

8. Method according to claim 1 in which the lubricant composition contains at least one member selected from the group consisting of solubilizing hydroxyl compounds, pH regulating agents, biocides and anticorrosion agents.

9. A concentrate suitable after dilution with water for use as a lubricant in mechanical metal working, comprising the following components in an amount within the range specified:

| | Range |
|---|---|
| Ether phosphate | From 2 to 50 percent by weight |
| Nonionic surface active compound | From 2 to 60 percent by weight |
| Anionic surface active compound | From 0 to 30 percent by weight |
| Cationic surface active compound | From 0 to 30 percent by weight |
| Polyalkylene oxide adduct | From 0 to 40 percent by weight |
| Solubility agent | From 0 to 40 percent by weight |
| Biocide | From 0 to 5 percent by weight |
| Water | From 10 to 70 percent by weight |

the ether phosphate being of the general formula

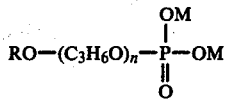

in which R is a hydrocarbon group having from six to twenty-four carbon atoms, n is 1 to 4 and M is hydrogen or a monovalent cation.

10. A concentrate according to claim 9, comprising the following components in an amount within the range specified:

| | Range |
|---|---|
| Ether phosphate | From 5 to 30 percent by weight |
| Nonionic surface active compound | From 5 to 35 percent by weight |
| Anionic surface active compound | From 2 to 15 percent by weight |
| Cationic surface active compound | From 0 to 5 percent by weight |
| Polyalkylene oxide adduct | From 5 to 30 percent by weight |
| Solubility agent | From 10 to 30 percent by weight |
| Biocide | From 0.5 to 3 percent by weight |
| Water | From 20 to 50 percent by weight |

* * * * *